US009327941B2

(12) United States Patent
Dold

(10) Patent No.: US 9,327,941 B2
(45) Date of Patent: May 3, 2016

(54) METHOD AND APPARATUS FOR CHECKING STATES IN AN ELEVATOR INSTALLATION

(71) Applicant: Inventio AG, Hergiswil NW (CH)

(72) Inventor: Florian Dold, Root (CH)

(73) Assignee: Inventio AG, Hergiswil (CH)

( * ) Notice: Subject to any disclaimer, the term of this patent is extended or adjusted under 35 U.S.C. 154(b) by 693 days.

(21) Appl. No.: 13/721,774

(22) Filed: Dec. 20, 2012

(65) Prior Publication Data

US 2013/0153340 A1 Jun. 20, 2013

(30) Foreign Application Priority Data

Dec. 20, 2011 (EP) ..... 11194604

(51) Int. Cl.
*B66B 1/34* (2006.01)
*B66B 5/00* (2006.01)
*B66B 7/12* (2006.01)

(52) U.S. Cl.
CPC ..... *B66B 5/0018* (2013.01); *B66B 7/1223* (2013.01)

(58) Field of Classification Search
CPC ..... B66B 5/0018; B66B 7/1223
USPC ..... 187/247, 391, 393; 73/158, 763, 770, 73/774, 788, 796, 826; 324/522, 523, 525, 324/691, 693
See application file for complete search history.

(56) References Cited

U.S. PATENT DOCUMENTS 4,145,920 A * 3/1979 Yamagami ..... B66B 7/1223 187/266
5,731,528 A * 3/1998 Yamazaki ..... G01L 5/042 73/828
7,409,870 B2 * 8/2008 Stucky ..... B66B 7/062 73/810
8,011,479 B2 * 9/2011 Stucky ..... B66B 7/1223 187/391
8,424,653 B2 * 4/2013 Stucky ..... B66B 7/1223 187/391
8,807,286 B2 * 8/2014 Puranen ..... B66B 5/0018 187/391
8,813,918 B2 * 8/2014 Kocher ..... B66B 7/1223 187/391
2002/0194935 A1 * 12/2002 Clarke ..... B66B 7/1223 73/862.391
2003/0121729 A1 * 7/2003 Heinz ..... B66B 7/062 187/254
2004/0026177 A1 * 2/2004 Ayano ..... B66B 1/34 187/247
2007/0181385 A1 * 8/2007 Veronesi ..... B66B 7/062 187/413
2010/0133046 A1 * 6/2010 Allwardt ..... B66B 7/08 187/251
2011/0192683 A1 * 8/2011 Weinberger ..... D07B 1/145 187/254
2013/0270042 A1 * 10/2013 Henneau ..... B66B 5/0006 187/251
2015/0330852 A1 * 11/2015 Garfinkel ..... B66B 7/062 73/766

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation includes a cage, a counterweight, a drive and at least one support element. The cage and the counterweight are supported by the support element, which is driven by the drive to move the cage and the counterweight in opposite directions. The support element includes at least one test element, wherein the test element is contacted by at least one contacting device and connected with a measuring device so that an electrical resistance of the test element is determinable by the measuring device, wherein the electrical resistance of the test element changes due to stretching of the test element so that through measurement of the electrical resistance of the test element at least one of the following states of the elevator installation is ascertainable: loading of the cage, a slack support element, a tension difference between at least two support elements and damage of the support element.

16 Claims, 3 Drawing Sheets

METHOD AND APPARATUS FOR CHECKING STATES IN AN ELEVATOR INSTALLATION

CROSS-REFERENCE TO RELATED APPLICATION

This application claims priority to European Patent Application No. 11194604.2, filed Dec. 20, 2011, which is incorporated herein by reference.

FIELD

The disclosure relates to checking states of an elevator installation.

BACKGROUND

In elevator installations it can be important to recognize safety-critical states in good time. Such safety-critical states are, for example, failure of a support element, overloading of a cage or driving of a cage without a counterweight in that case being moved oppositely. Such and other safety-critical states are monitored by respectively associated safety systems. Thus, for example, loading of the cage is monitored by load measuring sensors. The state of a support element is monitored by, for example, optical checking systems or by magnetic sensors.

SUMMARY

In at least some embodiments, a device or method allows multiple safety-critical states of an elevator installation to be monitored by only one monitoring device.

Some embodiments include a method for monitoring states of the elevator installation, wherein the elevator installation comprises a cage, a counterweight, a drive and at least one support element, wherein the cage and the counterweight are supported by the support element and wherein the drive drives the support element in order to move the cage and the counterweight in opposite directions. The support element comprises a casing and at least one tensile carrier and at least one test element, wherein the test element is constructed as an element separate from the tensile carrier and wherein tensile loading is accepted substantially by the tensile carrier. The method comprises the steps of:

applying an electrical voltage to at least one test element, which is arranged in the support element; determining an electrical resistance of the test element, wherein the electrical resistance of the test element changes due to stretching of the test element; detecting a travel state of the cage; and evaluating the electrical resistance of the test element and the travel state of the cage in order to be able to ascertain at least one of the following states of the elevator installation:

- loading of the cage;
- slack support element;
- tension differences between at least two support elements; and
- damage of the support element.

This method can provide that a plurality of safety-critical states of an elevator installation can be monitored by only one monitoring system, namely a test element which is arranged in the support element. Since information about the travel state of the cage at any point of time can be called up from an elevator control, no additional monitoring systems are needed for that purpose. In addition, through integration of the test element in the support element no additional space in the elevator installation is demanded. Moreover, such an integrated test element can be less susceptible to defects.

In some embodiments, through the method of checking states of an elevator installation at least two or three or four of the following states of the elevator installation are ascertainable:

- loading of the cage;
- slack support element;
- tension differences between at least two support elements; and
- damage of the support element.

Use of this method for checking a plurality of safety-critical states of an elevator installation can mean that separate monitoring systems do not have to be used for the individual ones of these states, which can be expensive and complicated in installation as well as operation.

In further embodiments the method for checking states of an elevator installation ascertains a loading of the cage in that an electrical resistance in the at least one test element is determined during standstill of the cage. For this purpose, use can be made of a single test element or, alternatively thereto, a plurality of test elements in a plurality of support elements can be provided. Since in elevator installations with a plurality of support elements usually not all support elements are loaded to the same extent at a specific point of time, it can be advantageous to use at least one test element in each support element in order to be able to ascertain the loading of the cage as precisely as possible. Since the electrical resistance of the test element is correlated with loading of the support element, a conclusion about a load in the cage can be derived from the determined electrical resistance of the test element. In order to ascertain overloading of the cage, the determined value of the electrical resistance of the test element is compared with a first threshold value, wherein overloading is present if the determined value is greater than the first threshold value. Thus, loading or overloading of the cage can be ascertained by the proposed method without separate measuring devices having to be provided in the cage for that purpose.

In further embodiments of the method for checking states of an elevator installation a slack support element is ascertained in that an electrical resistance in the at least one test element is determined during standstill or during travel of the cage and in that the measured value is compared with a second threshold value, wherein a slack support element is present if the determined value is smaller than the second threshold value. In an alternative form of embodiment a slack support element is ascertained in that an electrical resistance in the at least one test element is repeatedly determined during standstill or during travel of the cage and in that a change in the measured values per unit of time is ascertained, wherein a slack support element is present if the ascertained change in the determined values per unit of time exceeds a predetermined amount. Here, too, it is possible to provide a single test element in a support element or alternatively thereto to provide a plurality of test elements in a single support element or also to provide a plurality of test elements in a plurality of support elements. Early recognition of a slack tensile carrier is of special importance particularly in a case of elevator installations with tensile carriers encased by plastics material, since such tensile carriers encased by plastics material have a higher traction on a drive pulley than conventional steel cables.

In further embodiments of a method for checking states of an elevator installation a tension difference between at least two support elements is ascertained in that electrical resistances in at least two test elements of two different support elements are determined during standstill or during travel of the cage. The determined values are then compared with one another, wherein a tension difference is present lithe determined values lie further apart than a predefined difference. Such a method for early recognition of tension differences between at least two support elements can allow that overloadings of individual support elements and thus premature failure of such support elements can be precluded. Such a method can in addition be used at the time of mounting an elevator installation in order to set a tension between several support elements to be uniform. Uniformly tensioned support elements can mean that not only travel behavior of the elevator installation, but also service life of the support elements are optimized.

In further embodiments of a method for checking states of an elevator installation damage of the support elements is ascertained in that an electrical resistance in the at least one test element is determined during standstill or during travel of the cage and in that the determined value is compared with a third threshold value, wherein damage of the support element is present if the determined value is greater than the third threshold value. Such a method for monitoring damage of the support element can allow that even support elements which have encased tensile carriers can thereby be checked in simple mode and manner. Depending on the respective arrangement of the test element in the support element it is possible through such a method to monitor either a tensile carrier or, however, a casing of the support element.

In further embodiments of a method for checking states of an elevator installation at least one of the following steps is triggered in the case of ascertaining a safety-critical state of the elevator installation:

transmitting a signal to a service center;

stopping the elevator; and holding the cage until the triggering state is no longer present.

Such a method can mean that not only a safety-critical state can thereby be recognized, but also the necessary steps for overcoming the safety-critical state are initiated.

Some embodiments of an elevator installation comprise a cage, a counterweight, a drive and at least one support element, wherein the cage and the counterweight are supported by the support element and wherein the support element is driven by the drive in order to move the cage and the counterweight in opposite directions. The support element comprises a casing and at least one tensile carrier and at least one test element, wherein the test element is constructed as an element separate from the tensile carrier and wherein a tension loading is substantially accepted by the tensile carrier and wherein the test element is connected by at least one contacting device with a measuring device so that an electrical resistance of the test element is determinable by the measuring device. The electrical resistance of the test element changes due to stretching of the test element so that at least one of the following states of the elevator installation is ascertainable by measuring the electrical resistance of the test element:

loading of the cage;

slack support element;

tension differences between at least two support elements; and damage of the support element.

In further embodiments of an elevator installation the test element extends substantially over the entire length of the support element. This can mean that changes in the support element leading to a safety-critical state can be monitored over the entire length of the support element.

In further embodiments several test elements are arranged parallel to one another in one support element. In that case, the parallel arranged test elements can be connected in parallel or in series depending on whether individual tensile carriers or the entire support element is to be monitored. Several test elements connected in series in a support element can allow that due to the thereby-achieved effective increase in the length of the test element changes in electrical resistance, which come into being due to a changed elongation of the test elements, are greater than in the case of shorter test elements, whereby a state of the elevator installation can be ascertained more precisely. In addition, in such an arrangement of the test elements in the support element only one contacting device can be used when free ends of the test elements connected in series lie at the same end of the support element. This can mean that contacting of the test elements can take place at only one end of the support element, which has the consequence of simpler assembly. Several test elements connected in parallel in a support element can mean that together with a suitable design of the circuits the individual tensile carriers of a support element can be monitored individually. Consequently, the number of test elements in the entire elevator installation, the number of test elements in a support element and the electrical connection of the individual test elements can all be matched to the respective monitoring conditions.

In further embodiments of an elevator installation the test element is arranged in a casing of the support element. As a result, for example, wear of the casing can be monitored or, however, loading of the casing at a specific place. Such an arrangement additionally can mean that the test element is electrically insulated by the casing.

In other embodiments of an elevator installation the test element is arranged in a tensile carrier of the support element. This can mean that direct monitoring of the respective tensile carrier is thereby made possible. In the case of electrically non-conductive tensile carriers the test element can be directly integrated in the tensile carrier. In the case of electrically conductive tensile carriers such as, for example, tensile carriers of steel wires, the test element is embedded in an electrically insulating material so that the test element is electrically insulated from its environment.

In further embodiments the test element is arranged in a neutral axis of the support element. This can mean that the test element is not prematurely worn by excessive loading in bending.

In further embodiments of an elevator installation the test element comprises at least one of the following elements: copper, nickel, manganese, iron, platinum, tungsten, silicon, boron and phosphorous. Such and other elements can be used individually or in combination with one another in order to impart to the test element the desired characteristics with respect to electrical resistance in dependence on the loading of the test element. One combination of some of the above-mentioned elements is, for example, constantan. In an alternative form of embodiment the test element comprises carbon fibers or coated fiber materials. In the case of coated fiber materials the coating is possibly electrically conductive and the fiber material is substantially electrically non-conductive.

The test element is constructed as an element separate from the tensile carrier and accepts substantially no tensile loads. The tensile loads acting on the support element are accepted by the tensile carrier. The test element is constructed as a separate element additionally to the tensile carriers. Since it is arranged in the support means, it experiences the same bendings and stretchings as the support means as a whole, but without in that case having to fulfill a supporting function.

This can mean that the test element can be constructed independently of further functionalities, i.e. the test element can, for example, be formed from materials which would not be suitable for construction of tensile carriers. Thus, a test element can be formed which is optimally suitable for its function, namely a change, which is as predictable as possible, in the electrical resistance in the case of different states of stretching.

BRIEF DESCRIPTION OF THE DRAWINGS

The disclosure refers to the schematic drawings, in which.

DETAILED DESCRIPTION

Figure 1:
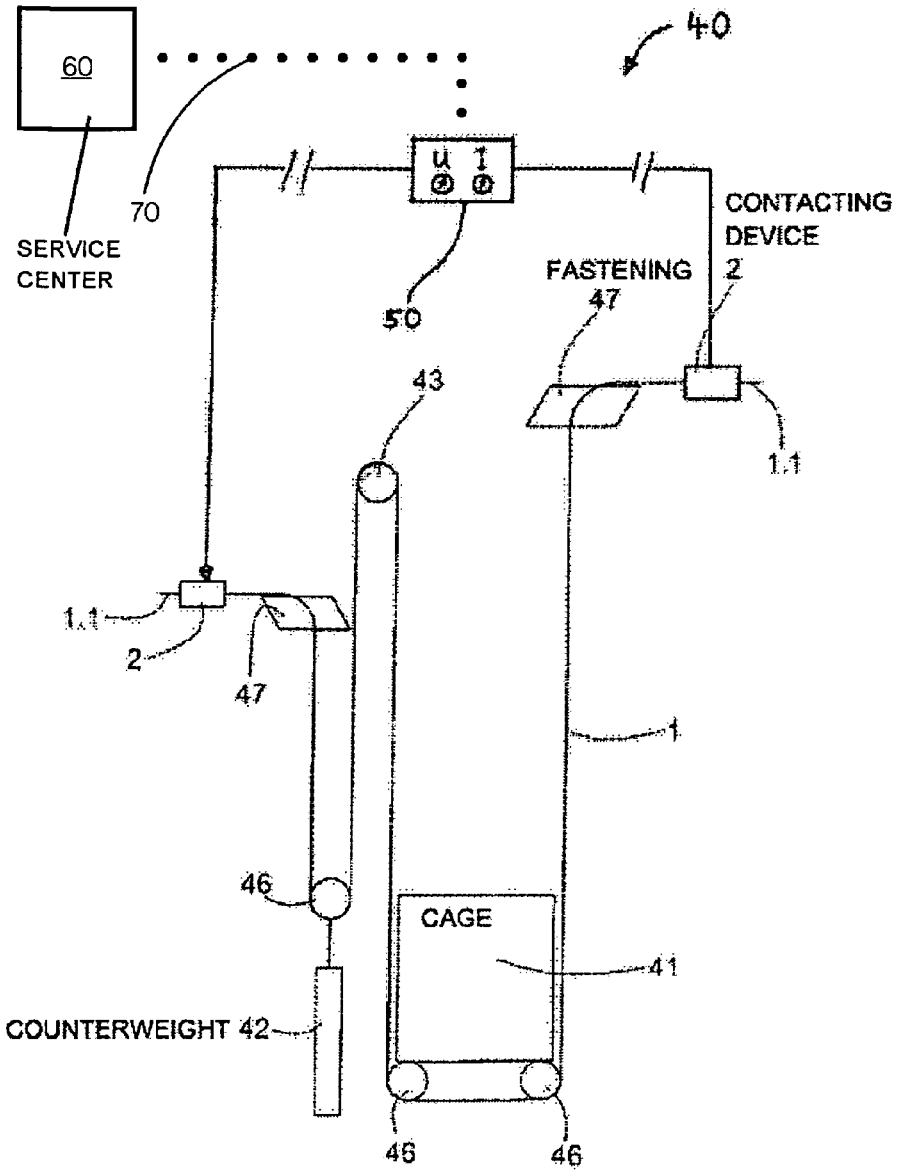
FIG. 1 shows an exemplifying form of embodiment of an elevator installation.

An exemplifying elevator installation 40 is illustrated in FIG. 1. The elevator installation 40 has an elevator cage 41, a counterweight 42 and a support element 1 as well as a drive 43. The drive 43 drives the support element 1 and thus moves the elevator cage 41 and the counterweight 42 in opposite sense. The cage 41 is designed to receive persons and/or goods and to transport them between stories of a building. Cage 41 and counterweight 42 are guided along guides (not illustrated). In the illustrated example, the cage 41 and the counterweight 42 are each suspended at support rollers 46. The support element 1 is in that case fixed to a first support means fastening device 47 and then guided initially around the support roller 46 of the counterweight 42. The support element 1 is then laid over a drive pulley of the drive 43, led around the support roller 46 of the cage 41 and finally connected with a fixing point by a second support means fastening device 47. This means that the support element 1 runs at a higher speed over the drive 43 in correspondence with a suspension factor. In the example the suspension factor is 2:1.

The support element 1 comprises a test element (not illustrated). A free end 1.1 of the support element 1 is provided with a contacting device 2 for contacting the test element. In the illustrated example, a contacting device 2 of that kind is arranged at both ends of the support element 1. In an alternative form of embodiment, which is not illustrated, only one contacting device 2 is arranged at one of the support means ends 1.1. In this case the test element is guided in a loop by the support means so that the start and end are arranged at one support element end 1.1 and can be correspondingly contacted by the contacting device 2. The support element ends 1.1 are no longer loaded by the tension force in the support element 1, since this tension force has already been conducted beforehand into the building by way of the support means fastenings 47. The contacting devices 2 are thus arranged in a region of the support element 1 which is not rolled over.

The two contacting devices 2 are connected together by a measuring device 50. The measuring device 50 thus closes an electrical circuit comprising the test element. The measuring device 50 is designed for the purpose of measuring the electrical current as well as the electrical voltage or changing them in their magnitudes. Since not only the electrical voltage, but also the electrical current in this electrical circuit are known, an electrical resistance of the test element can be determined. From the thus-determined electrical resistance of the of the test element a conclusion about a state of the installation 40 can then be made. In the case of exceeding or falling below specific threshold values it can be ascertained, in dependence on the travel state of the cage 41, whether or not a specific safety-critical state is present. The measuring device 50 can also provide a signal 70 that is transmitted to a service center 60 relaying whether the safety-critical state is present.

The illustrated elevator installation 40 in FIG. 1 is by way of example. Other suspension factors and other arrangements are possible. The contacting devices 2 for contacting the test element are then arranged in correspondence with the placement of the support means fastenings 47.

Different exemplifying embodiments of support elements 1 with integrated test element are illustrated in FIGS. 2*a* to 2*d*. It is apparent from the different exemplifying embodiments that the test element 8 can be arranged in different modes and manners in the support element 1. Depending on the respective purpose of use of the measurement results the test element 8 can be arranged at a different place in the support element 1.

Figure 2A:
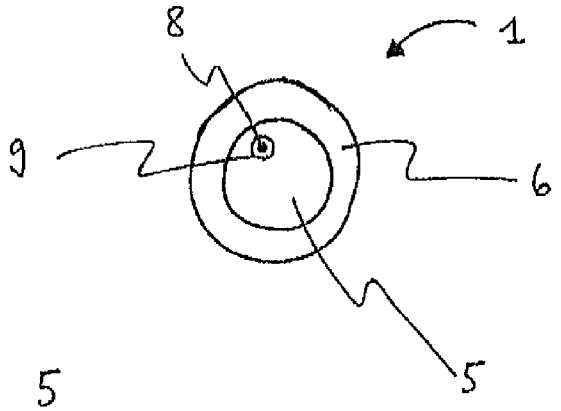
FIGS. 2*a* to 2*d* show exemplifying forms of embodiment of support elements for use in an elevator installation.

A support element 1 consisting of tensile carrier 5 and a casing 6 is illustrated in FIG. 2*a*. The test element 8 is in that case arranged outside the center of the tensile carrier 5. In order to electrically insulate the test element 8 relative to the immediate environment the test element 8 is embedded in an electrically insulating material 9.

Figure 2B:
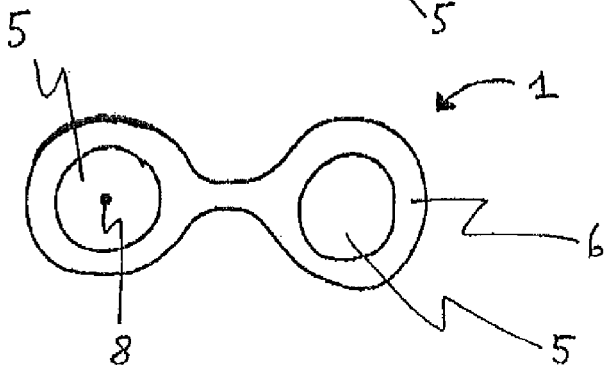

A support element 1 consisting of two tensile carriers 5 and a common casing 6 is illustrated in FIG. 2*b*. In this example a test element 8 is arranged in one of the two tensile carriers 5, wherein the second tensile carrier 5 is constructed without a test element. Depending on the respective purpose of checking it can be sufficient to monitor only a part of the tensile carrier 5. In this embodiment the test element 8 is arranged in the neutral axis of the tensile carrier 5. This has the advantage that the test element 8 is not excessively loaded in the case of reverse bending of the support element 1.

Figure 2C:
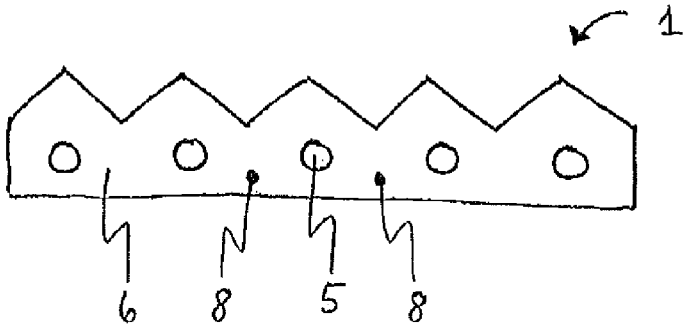

A support element 1 consisting of five tensile carriers 5, which are arranged in a common casing 6, is illustrated in FIG. 2*c*. The support element 1 has a traction side with longitudinal ribs and a rear side, which is formed to be substantially straight. In this embodiment two test elements 8 are arranged in the casing 6 of the support element 1. Through the arrangement of the test elements 8 in the casing 6 the test elements 8 are electrically insulated by the tensile carriers 5.

Figure 2D:
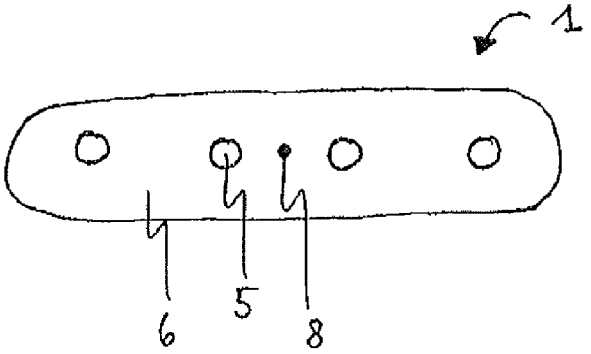

A further embodiment of a support element 1 is illustrated in FIG. 2*d*. In this embodiment the support element 1 comprises four tensile carriers 5 in a common casing 6 and a centrally arranged test element 8.

Many more arrangements of the test element 8—or the test elements 8—in many more forms of embodiment of support elements 1 are possible. Depending on the respective demands on monitoring and depending of the respective construction of the elevator installation different arrangements of the test element 8 in the support element 1 can be advantageous. Thus, for example, it can be advantageous for monitoring the support element 1 for damage to provide each individual support element 1 of an elevator installation with a test element 8 or even to provide each individual tensile carrier 5 of a support element 1 with a test element 8. For monitoring loading of the cage it can, on the other hand, be sufficient to provide merely one test element 8 in a support element 1 of an elevator installation. In addition, the length of the support element 1 as well as guidance of the support element 1 in the elevator installation may require a specific arrangement of the test element 8.

Figure 3:
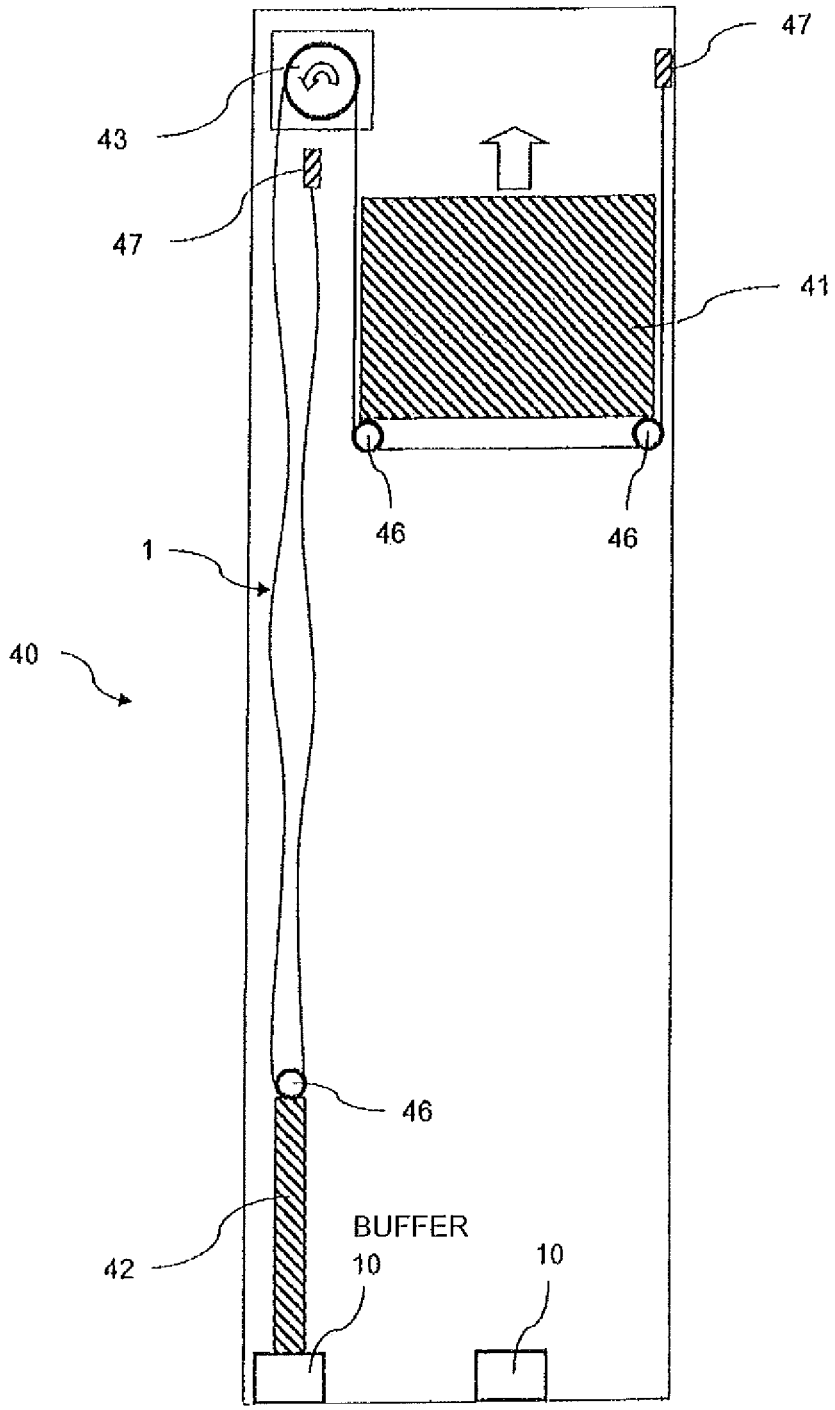
FIG. 3 shows an exemplifying form of embodiment of a safety-critical state of an elevator installation.

An exemplifying elevator installation 40 in a safety-critical state is illustrated in FIG. 3. As in FIG. 1, here, too, not only the cage 41, cut also the counterweight 42 are suspended by support rollers 46 from the support element 1. In the illustrated situation the counterweight 42 has run onto a buffer 10 associated with the counterweight 42. If now the drive 43 transports the support element 1 further on one side of the counterweight 42, the elevator cage 41 can be further raised without the counterweight 42 in that case being able to further sink. However, this is possible only if the traction of the support element 1 on the drive pulley of the drive 43 is sufficiently large. If the cage 41 is now raised further, the support element 1 slackens on the side of the counterweight 42. In that case it can happen that the traction of the support element 1 on the drive pulley 43 is no longer sufficient in order to hold the cage 41 in its too-high position. In the case of such a traction loss, the cage 41 drops back at least to such an extent until the entire support element 1 is stretched again. Such a dropping back is dangerous for any passengers and should be avoided in all circumstances.

Through the method proposed here or through the device proposed here for the checking of states of an elevator installation such a safety-critical state can be recognized in good time. As soon as a slack support element 1 forms on one side of the drive pulley the loading of the support element 1 diminishes and the test element in the support element 1 is thereby less stretched. The specific electrical resistance of the test element in this situation is then smaller than it should be in a non-critical state. Consequently, it can be ascertained that a safety-critical state prevails.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. A method of checking states of an elevator installation, the method comprising:

applying an electrical voltage to a test element, the elevator installation comprising a cage, a counterweight, a drive and a support element supporting the cage and the counterweight, the support element comprising a casing, a tensile carrier and the test element, the test element being constructed as a separate element from the tensile carrier, the test element being in the casing of the support element, a tension loading being substantially accepted by the tensile carrier;

determining an electrical resistance of the test element, the electrical resistance of the test element being changeable by stretching of the test element;

detecting a travel state of the cage; and evaluating the electrical resistance of the test element and the travel state of the cage to determine an elevator state for at least one of loading of the cage, support element slack, support element damage, and a tension difference between the support element and a further support element.

2. The method of claim 1, the evaluating comprising determining the elevator state for at least two of loading of the cage, support element slack, support element damage, and the tension difference between the support element and the further support element.

3. The method of claim 1, the evaluating comprising determining the elevator state for loading of the cage.

4. The method of claim 1, the electrical resistance of the test element being determined during a standstill of the cage to determine the loading of the cage.

5. The method of claim 4, further comprising:

determining that the electrical resistance is greater than a threshold value; and determining that overloading has occurred.

6. The method of claim 1, the electrical resistance in the test element being determined during standstill of the cage or during travel of the cage, the method further comprising:

determining that the electrical resistance is smaller than a threshold value; and determining that the support element is slack.

7. The method of claim 1, the electrical resistance in the test element being determined repeatedly during standstill of the cage or during travel of the cage, the method further comprising:

determining a change over time in the repeatedly determined electrical resistance in the test element, the determined change over time exceeding a predetermined amount; and determining that the support element is slack.

8. The method of claim 1, the elevator installation further comprising an additional support element, the additional support element comprising an additional test element, the electrical resistance of the test element being determined during standstill of the cage or during travel of the cage, the method further comprising:

determining an electrical resistance of the additional test element;

determining that a difference between the electrical resistance of the test element and the electrical resistance of the additional test element exceeds a predefined difference; and determining that a tension difference is present.

9. The method of claim 1, the electrical resistance in the test element being determined repeatedly during standstill of the cage or during travel of the cage, the method further comprising:

determining that the electrical resistance is greater than a threshold value; and determining that the support element is damaged.

10. The method of claim 1, further comprising transmitting a signal to a service center, stopping the elevator installation, or holding the cage until the determined elevator state is no longer present.

11. An elevator installation, comprising:

a cage;

a counterweight;

a drive;

a support element coupled to the cage and the counterweight, the support element being driven by the drive, the support element comprising a casing, a tensile carrier and a test element, the test element being constructed as a separate element from the tensile carrier, the test element being in the casing of the support element, a tension loading being substantially accepted by the tensile carrier, a contacting device, the contacting device being electrically connected to the test element; and a measuring device for an electrical resistance of the test element, the measuring device being connected to the test element, the electrical resistance of the test element being changeable according to a stretching of the test element, the elevator installation using a determined electrical resistance of the test element to determine an elevator state for at least one of loading of the cage, support element slack, support element damage, and a tension difference between the support element and a further support element.

12. The elevator installation of claim 11, the test element extending substantially over the entire length of the support element.

13. The elevator installation of claim 11, the test element being arranged in the tensile carrier of the support element.

14. The elevator installation of claim 11, the test element being embedded in an electrically insulating material.

15. The elevator installation of claim 11, the test element comprising one or more of copper, nickel, manganese, iron, platinum, tungsten, silicon, boron and phosphorus.

16. The elevator installation of claim 11, the test element comprising fiber materials.

* * * * *